United States Patent [19]

Green

[11] Patent Number: 4,954,271

[45] Date of Patent: Sep. 4, 1990

[54] NON-TOXIC FIRE EXTINGUISHANT

[75] Inventor: Raymond W. Green, Vancouver, Canada

[73] Assignee: Tag Investments, Inc., Vancouver, Canada

[21] Appl. No.: 255,133

[22] Filed: Oct. 6, 1988

[51] Int. Cl.[5] ..... A62D 1/00; A62C 1/00; A62C 3/00

[52] U.S. Cl. ..... 252/8; 169/46; 169/47; 252/2

[58] Field of Search ..... 252/2, 8; 169/46, 47

[56] References Cited

U.S. PATENT DOCUMENTS

| | | | |
|---|---|---|---|
| Re. 29,649 | 5/1978 | Farnsworth | 252/DIG. 8 |
| 3,480,545 | 11/1969 | Dale | 252/2 |
| 3,609,074 | 9/1971 | Rainaldi et al. | 252/3 |
| 3,879,297 | 4/1975 | Languille et al. | 252/8 |
| 4,226,727 | 10/1980 | Tarpley, Jr. et al. | 252/8 |
| 4,226,728 | 10/1980 | Kung | 252/8 |
| 4,459,213 | 7/1984 | Uchida et al. | 252/2 |
| 4,668,407 | 5/1987 | Gerard et al. | 252/8 |
| 4,826,610 | 5/1989 | Thacker | 252/8 |

*Primary Examiner*—Howard J. Locker

*Attorney, Agent, or Firm*—Christie, Parker & Hale

[57] ABSTRACT

This invention is directed to a non-toxic fire extinguishant. More particularly, this invention relates to a fire extinguishant which extinguishes fires without generating toxic gases or compounds. A non-toxic fire extinguishant comprising in combination: (a) A fluorochlorocarbon selected from the group consisting of trichlorofluoromethane, dichlorodifluoromethane, 1,2-dichlorotetrafluoroethane, chlorodifluoromethane, 1,1-dichloro-2,2,2-trifluoroethane, 1-chloro-1,2,2,2-tetrafluoroethane, pentafluoroethane, 1,2-dichloro-2,2-difluoroethane, 1,2,2,2-tetrafluoroethane and (b) a substance selected from the group consisting of Terpenes: Citral, Citronellal, Citronellol, Limonene, Dipentene, Menthol, Terpinene, Terpinolene, Sylvestrene, Sabinene, Menthadiene, Zingiberene, Ocimene, Myrcene, α-Pinene, β-Pinene, Turpentine, Camphor, Phytol, Vitamin A, Abietic Acid, Squalene, Lanosterol, Saponin, Oleanolic Acid, Lycopene, β-Carotene, Lutein, α-Terpineol, p-Cymeme; and unsaturated oils: Oleic Acid, Linoleic Acid, Linolenic Acid, Eleostearic Acid, Lincanic Acid, Ricinoleic Acid, Palmitoleic Acid, Petroselenic Acid, Vaccenic Acid, Erucic Acid.

4 Claims, No Drawings

NON-TOXIC FIRE EXTINGUISHANT

FIELD OF THE INVENTION

This invention is directed to a non-toxic fire extinguishant. More particularly, this invention relates to a fire extinguishant which extinguishes fires without generating toxic gases or compounds.

BACKGROUND OF THE INVENTION

For many years, the technology of fire extinguishants was directed to extinguishing a fire rapidly without any regard to whether the products generated in extinguishing the fire were toxic to humans or damaging to the environment.

There have been no significant improvements in the development of fire extinguishants during the past twenty-five years. However, during the interim, there has been a systematic and progressive ban on the continued use of effective widely used extinguishing agents such as carbontetrachloride and Halon 2402. These substances have been demonstrated to have immediate toxic effects. It is expected that additional regulations will be enacted in future to control the negative environmental impact of the few effective fire extinguishants that are still approved. No fire extinguishants exist or are in use at the present time that are effective, and yet clean, nontoxic, nonhazardous, noncorrosive, and generally environmentally safe.

Derek A. Thacker has conducted research into developing effective fire extinguishing and fire retarding agents including developing fire extinguishants which have non-toxic qualities. D. A. Thacker is the inventor identified in U.S. Pat. Application Ser. No. 003,445, filed Jan. 15, 1987, for a fire extinguishant (counterpart Canadian Application Ser. No. 527,276, filed Jan. 13, 1987) and co-pending U.S. Patent Application Ser. No. 112,459, filed Oct. 26, 1987 for a fire retardant composition (Canadian counterpart Application Ser. No. 550,274, filed Oct. 26, 1987).

SUMMARY OF THE INVENTION

This invention pertains to a novel fire extinguishant which is made up of a group of compounds which act in concert to extinguish fires without generating toxic gases. Chemical additives are used in the extinguishant to detoxify, by means of rapid chemical reaction, the toxic combustion products that are generated by fire extinguishants incorporated in the composition. These extinguishants, used by themselves, have been rejected by regulatory authorities because on chemical decomposition they convert into toxic products at elevated temperatures or are damaging to the environment. The detoxifying additives that are used in the formulation of the invention are approved food additives according to the United States Food and Drug Administration, Title XXI.

The invention is directed to a non-toxic fire extinguishant comprising in combination:

(a) a fluorochlorocarbon selected from the group consisting of trichlorofluoromethane 1,1-dichloro-2,2,2-trifluoroethane 1,2-dichloro-2,2-difluoroethane;

(b) a fluorochlorocarbon or fluorocarbon selected from the group consisting of dichlorodifluoromethane 1,2-dichlorotetrafluoroethane chlorodifluoromethane 1-chloro-1,2,2,2-tetrafluoroethane pentafluoroethane 1,2,2,2-tetrafluoroethane; and (c) a substance selected from the group of Terpenes: Citral, Citronellal, Citronellol, Limonene, Dipentene, Menthol, Terpinene, Terpinolene, Sylvestrene, Sabinene, Menthadiene, Zingiberene, Ocimene, Myrcene, α-Pinene, β-Pinene, Turpentine, Camphor, Phytol, Vitamin A, Abietic Acid, Squalene, Lanosterol, Saponin, Oleanolic Acid, Lycopene, β-Carotene, Lutein, α-Terpineol and p-Cymeme; and unsaturated oils: Oleic Acid, Linoleic Acid, Linolenic Acid, Eleostearic Acid, Lincanic Acid, Ricinoleic Acid, Palmitoleic Acid, Petroselenic Acid, Vaccenic Acid and Erucic Acid.

Performance criteria established for the effective extinguishment of fires dictate certain limitations on the composition of the extinguishant.

(1) the fluorochlorocarbon given in list (a) should comprise between 50 to 98% by weight of the total weight of the extinguishant.

(2) the terpenes and unsaturated oils given in list (c) should comprise more than 2% but less than 10% by weight of the total weight of the extinguishant, and (3) the fluorochlorocarbon given in list (b) should comprise between zero and 48% by weight of the total weight of the extinguishant. The specific percentages selected under these limitations regarding compound and composition are governed by the technique of application, the cost of material, and environmental impact.

A specific non-toxic fire extinguishant suitable for hand-held units has the formula:

65% trichlorofluoromethane, or 1,1-dichloro-2,2,2-trifluoroethane, or 1,2-dichloro-2,2-difluoroethane 15% dichlorodifluoromethane 15% 1,2-dichlorotetrafluoroethane 5% dipentene Another specific non-toxic fire extinguishant has the formula 90% trichlorofluoromethane, or 1,1-dichloro-2,2,2-trifluoroethane, or 1,2-dichloro-2,2-difluoroethane 10% linoleic acid

DETAILED DESCRIPTION OF SPECIFIC EMBODIMENTS OF THE INVENTION

Fluorochlorocarbons, of the type used as vaporizing refrigerant liquids, have very little negative environmental impact on the ozone layer relative to approved halon extinguishants (containing bromine) such as Halon 1211 and 1301 (trade names).

Many fluorochlorocarbons exhibit remarkable fire extinguishing capacity on wood, hydrocarbon and electrical fires They have very low toxicity except when pyrolyzed at elevated temperatures. The fluorochlorocarbons have, however, been shown to decompose in a fire giving dangerous concentrations of primarily hydrogen chloride, and secondarily, hydrogen fluoride, chlorine and fluorine.

We have discovered that the problem of volatile fluorochlorocarbons generating dangerous compounds upon ignition can be solved by dissolving a small percentage of either terpenes or unsaturated oil in the fluorocarbon extinguishant mixture. While we do not wish to be adversely bound by any theories, we believe that the chemically active double bonds contained in the terpene or unsaturated oil quickly neutralize the expected toxic gases by innocuous chemical combination. We have conducted roomscale fire extinguishing tests using detoxified fluorochlorocarbon mixtures at the British Columbia Research Council, Vancouver, Canada, and have demonstrated that properly selected terpenes and unsaturated vegetable oils dramatically reduce the concentrations of expected toxic hydrogen halides and halogens to levels less than one-tenth that of generally accepted "Immediate Danger to Life and Health" (IDLH) levels The carbonyl halides generated have been shown to comprise less than one part per million, which is the level to be expected in the presence of water vapour produced by a typical fire.

We have identified three fluorochlorocarbons which are currently commercially available and are useful for the purpose of extinguishing fires One is trichlorofluoromethane which normally boils at 24° Celsius. It has a slow fire extinguishing effect compared to some other fluorochlorocarbons but it has a longer throw. The throw is the distance the extinguishant can be projected into a fire without losing fire extinguishing effectiveness. Another is 1,2-dichlorotetrafluoroethane, which normally boils at 4° Celsius, has a good fire extinguishing effect but a shorter throw than trichlorofluoromethane. The third is dichlorodifluoromethane, which normally boils at −30° Celsius, has good fire extinguishant properties and also has a dispersing effect on the pattern of the effluent extinguishant.

We have unexpectedly noted that the pattern of the effluent extinguishant can produce a five-fold change in fire extinguishing efficiency. We have developed fire extinguishant compositions comprising fluorochlorocarbon mixtures that have optimum effect over a broad range of typical fires. The compositions are rich in trichlorofluoromethane to prevent reignition of extinguished fires.

We have discovered that two specific detoxifying agents, dipentene and linoleic acid, are especially effective in fire extinguishant mixtures. Dipentene, a natural product found in citrus fruit skin, is nontoxic, highly volatile, soluble in fluorocarbon mixtures, and has been proven to be an effective agent for combining and detoxifying unwanted toxic combustion products. Linoleic acid, which is the main component in sunflower and safflower cooking oil, is nontoxic, soluble in fluorochlorocarbon mixtures that are of interest in the invention as fire extinguishants, and has been proven by our tests to be an effective agent for combining with and neutralizing unwanted toxic combustion products However, unlike dipentene, linoleic acid is not very volatile and we have found that it leaves a slight residue after the extinguishant evaporates. Since it is less volatile than dipentene, however, linoleic acid has the advantage that it improves the throw of the extinguishant to distances as high as 100 meters We are inclined to conclude from this that linoleic acid is best suited for use in an extinguishant designed for extinguishing outdoor fires while dipentene with its higher volubility and absence of residue is best suited for use in an extinguishant intended for extinguishing indoor fires.

EXAMPLE 1

INEFFECTIVE FIRE EXTINGUISHANTS

The Underwriter's Laboratories of Canada and the United States have specified performance criteria for satisfactory extinguishants. One of the simplest criteria is the IB-Test where 12.5 liters of N-heptane is placed in a 2.5 square foot area pan and allowed to reach a maximum rate of burn. An extinguishant which kills this IB-Fire would bear a IB rating while an extinguishant which kills a N-heptane fire twice as large would bear a 2B rating, and so forth.

As a comparison to Example 2 above, a commercially available extinguisher containing Halon 1211 and bearing a ULC 2B rating was used on a full 1B fire in an outdoor setting A passive stand-back technique was used. We found that this 2B unit failed to extinguish the IB fire firstly due to the passive stand-back technique employed by the operator, and secondly due to the presence of a gentle wind of 5 to 7 mph.

EXAMPLE 2

The following fire extinguishant formulation has been demonstrated to have good fire extinguishant properties without generating toxic combustion by-products. For ease of identification, the formulation has been identified as NAF INDOOR mixture (trade mark NAF). The NAF INDOOR mixture has the following composition on a weight percentage basis:

65% fluorotrichloromethane
15% difluorodichloromethane
15% 1,2-dichlorotetrafluoroethane
5% dipentene This indoor fire extinguishant NAF INDOOR mixture has been proven effective using handheld portable extinguishers on fires fueled with wood and hydrocarbons including n-heptane. It has also proved effective in extinguishing electrical fires. We have also found the NAF INDOOR mixture to be effective in automatic sprinkler or automatic flood systems. At normal temperatures, the four ingredients are miscible and chemically inert with respect to each other. They also do not corrode typical metal containers.

In a typical performance test conducted by technicians at the Underwriters Laboratories' of Canada, (2.5 square feet ULC 1B test) 367 milliliters of mixture (532 grams) were demonstrated to extinguish 12.5 liters of burning n-heptane in 1.9 seconds. This result was obtained with a passive stand-back technique normally used by an inexperienced fire fighter. An aggressive technique permitted by the Underwriters' Laboratories testing method was not required Smoke generation was observed to be minimal and did not obscure a view of the fire, the extinguishant stream, or a route of escape.

Similar results (see Example 3 below) were obtained for standard wood fires (ULC 1A test) and fires extinguished by automatic flood/sprinkler units.

This mixture has been shown to be a safe nonconductor of electrical current at 150,000 volts in tests conducted an Imperial College.

PHYSICAL PROPERTIES NAF INTERIOR MIXTURE

Toxicity 350,000 ppm 30 min 50% lethal; observed boiling point 10 Celsius (50 Fahrenheit); density (10C) 1.44 g/ml. Evaporation rate 3.4 mg/cm$^2$/sec

| TEMPERATURE | | VAPOUR PRESSURE |
|---|---|---|
| −40 C. | −40 F. | 0.16 ATM |
| −20 C. | −4 F. | 0.40 ATM |
| 0 C. | 32 F. | 0.89 ATM |
| 20 C. | 68 F. | 1.75 ATM |

-continued

| TEMPERATURE | VAPOUR PRESSURE |
|---|---|
| 40 C. 104 F. | 3.16 ATM |

EXAMPLE 3

A wood fire was prepared according to United States Underwriter's Laboratory specifications consisting of 10 layers of dry wood members measuring 2 x 2 x 20 inches with 5 members in each layer. This structure was ignited using N-heptane and it was allowed to burn for eight minutes to ensure that the fire was well established and "deep seated". An extinguisher which would kill this fire would be given a IA rating and extinguishers which would kill larger wood fires of similar design would be given higher A-ratings.

When one-half kilogram of the NAF interior mixture was applied to three sides and the top surface of the IA wood fire, the fire was extinguished in less than five seconds

EXAMPLE 4

The following fire extinguishant formulation has been demonstrated to have good fire extinguishant properties without generating toxic combustion by-products. For ease of identification, the mixture has been identified as NAF EXTERIOR mixture.

The NAF-EXTERIOR mixture (trade mark BLITZ) has the following composition on a weight percentage basis 90% fluorotrichloromethane 10% linoleic acid This mixture has been proven effective for use on large outdoor fires where water should not be used and the magnitude of the fire requires a throw ranging from about 10 to about 100 meters. At these longer throw distances, difluorodichloromethane is not desirable because it forces a wider dispersion of the effluent stream thereby reducing fire extinguishing capacity In such cases, additional linoleic acid is desirable to prevent excessive dispersion in the stream pattern.

A performance test of this mixture was conducted at the Transport Canada Training Facility at Abbotsford Airport, British Columbia, under the supervision of a large group of interested governmental and corporate personnel. Approximately 2000 liters of jet fuel was poured into a 50 by 100 foot shallow burning pit, which was partially filled with natural rain water. The jet fuel was ignited and allowed to reach a maximum rate of burn. A helicopter hovering at approximately 50 meters altitude upwind to the fire released 400 liters of NAF-OUTDOOR mixture which dispersed as it fell so as to cover nearly all of the upwind edge of the fire pit The misty vapour cloud was observed to extinguish the fire locally as it drifted across the fire pit. After ten seconds, the isolated residual flames scattered along the downwind edge of the fire pit were extinguished using a single handheld extinguisher containing two kilograms of NAFOUTDOOR mixture. The winds were measured to be between five and ten knots Attempts to deliberately re-ignite the unburned fuel remaining in the pit failed for several minutes.

Scale model experiments conducted before the above described outdoor test have demonstrated that a mixture of five part of gasoline and one part of NAF OUTDOOR mixture cannot be ignited with matches.

PHYSICAL PROPERTIES NAF EXTERIOR

Toxicity 330,000 ppm 30min 50% lethal; observed boiling point 27 Celsius 81 Fahrenheit; density 1.46 gram/milliliter; evaporation rate 1.5 mg/cm$^2$/sec.

| TEMPERATURE | VAPOUR PRESSURE |
|---|---|
| −40 C. −40 F. | 0.05 ATM |
| −20 C. −4 F. | 0.14 ATM |
| 0 C. 32 F. | 0.36 ATM |
| 20 C. 68 F. | 0.78 ATM |
| 40 C. 104 F. | 1.54 ATM |

ALTERNATIVE FORMULATIONS The two NAF-mixtures NAF at disclosed herein impact the ozone layer at lower levels than current Halon extinguishants. This is demonstrated by the following comparison

| EXTINGUISHANT | OZONE IMPACT |
|---|---|
| NAF | 0.9 |
| BLITZ | 0.9 |
| Halon 1211 | 3.0 |
| Halon 1301 | 10.0 |

Nonetheless, the NAF-extinguishants can be formulated to reduce the ozone-impact to levels less than 0.05 by substituting the following fluorochlorocarbons in place of those listed in Examples 2, 3 and 4 above.

| NAME | BOILING POINT | OZONE IMPACT |
|---|---|---|
| chlorodifluoromethane | −40.8 | 0.05 |
| 1,1-dichloro-2,2,2-trifluoroethane | 28.7 | 0.05 |
| 1-chloro-1,2,2,2-tetrafluoroethane | −12 | 0.05 |
| pentafluoroethane | −48.5 | 0.00 |
| 1,2-dichloro-2,2-difluoroethane | 46.8 | 0.05 |
| 1,2,2,2-tetrafluoroethane | −26.5 | 0.00 |

With the single exception of chlorodifluoromethane, none of these fluorochlorocarbons are being manufactured in 1988 on an economically practical scale. Thus the two formulations stated above are preferred strictly for availability and economic reasons Also dipentene and linoleic acid are the preferred detoxifying agents. However, a list of acceptable substitutes for these two agents is stated below. It includes virtually all of the terpenes normally isolated from plant material by means of steam distillation. It also includes most of the unsaturated fats and oils usually separated from natural sources.

| TERPENES | UNSATURATED OILS |
|---|---|
| Citral | Oleic Acid |
| Citronellal | Linoleic Acid |
| Citronellol | Linolenic Acid |
| Limonene | Eleostearic Acid |
| Dipentene | Lincanic Acid |
| Menthol | Ricinoleic Acid |
| Terpinene | Palmitoleic Acid |
| Terpinolene | Petroselenic Acid |
| Sylvestrene | Vaccenic Acid |
| Sabinene | Erucic Acid |
| Menthadiene | |
| Zingiberene | |

-continued

| TERPENES | UNSATURATED OILS |
|---|---|
| Ocimene | |
| Myrcene | |
| α-Pinene | |
| β-Pinene | |
| Turpentine | |
| Camphor | |
| Phytol | |
| Vitamin A | |
| Abietic acid | |
| Squalene | |
| Lanosterol | |
| Saponin | |
| Oleanolic Acid | |
| Lycopene | |
| β-Carotene | |
| Lutein | |
| α-Terpineol | |
| p-Cymene | |

Clearly, the possible compositional variations on the basic formulation of NAF extinguishants are extensive in number. Notwithstanding, all effective variations must generally obey the basic principles noted according to the invention. To obtain efficient fire extinguishment, the formulated composition must satisfy the following criteria:

(1) The detoxifying additive, dipentene, linoleic acid, or the above-listed substitutes, must be present at a concentration of at least about 2% by weight of the overall formulation in order to achieve chemical detoxification of the fluorochlorocarbon. On the other hand, these additives cannot exceed about 10% by weight of the overall formulation without degrading the fire extinguishing capability of the resultant mixture.

(2) The use in a formulation of higher boiling fluorochlorocarbons such as trichlorofluoromethane, 1,2-dichloro-2,2-difluoroethane, and or 1,1-dichloro-2,2,2-trifluoroethane, singly or in combination, must exceed about 50% by weight of the resultant mixture The use of higher boiling components at these levels prevents flashback.

(3) The use of lower boiling fluorochlorocarbons or fluorocarbons such as dichlorodifluoromethane, 1,2-dichlorotetrafluoroethane, 1-chloro-1,2,2,2-tetrafluoroethane, 1,2,2,2-tetrafluoroethane, chlorodifluoromethane, and/or pentafluoroethane, singly or in combination, must not exceed about 48% by weight of the resultant mixture. Lower boiling components provide wider dispersion and faster action of the extinguishant at short range for hand-held units but have the disadvantage of reduced throw.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. A non-toxic fire extinguishant consisting essentially of:

65% trichlorofluoromethane,
15% dichlorodifluoromethane,
15% 1,2-dichlorotetrafluoroethane, and 5% dipentene by weight of the overall extinguishant.

2. A non-toxic fire extinguishant consisting essentially of:

65% 1,1-dichloro-2, 2, 2-trifluoroethane,
15% difluorodichloromethane,
15% 1, 2-dichlorotetrafluoroethane, and
5% dipentene.

3. A non-toxic fire extinguishant consisting essentially of:

65% 1,2-chloro-2, 2-difluoroethane,
15% difluorodichloromethane,
15% 1, 2-dichlorotetrafluoroethane, and
5% dipentene.

4. A non-toxic fire extinguishant comprising in combination:

(a) more than 50% by weight of a fluorochlorocarbon selected from the group consisting of:
1,1-dichloro-2, 2, 2-trifluoroethane, and 1,2-dichloro-2, 2-difluoroethane;

(b) less than 48% by weight of a fluorocarbon selected from the group consisting of:
chlorodifluoromethane
1-chloro-1, 2,2,2-tetrafluoroethane pentafluoroethane 1,2,2,2-tetrafluoroethane; and (c) a substance selected from the group consisting of terpenes: citral, citronellal, citronellol, limonene, dipentene, menthol, terpinene, terpinolene, sylvestrene, sabinene, methadiene, zingiberene, ocimene, myrcene, a- pinene, β-pinene, turpentine, camphor, phytol, vitamin A, abietic acid, squalene, lanosterol, saponin, oleanolic acid, lycopene, βcarotene, lutein, a-terpineol, and p-cymeme; and unsaturated oils; oleic acid, linoleic acid, linolenic acid, eleosearic acid, lincanic acid, ricinoleic acid, palmitoleic acid, petroselenic acid, vaccenic acid, and erucic acid, in the range of from 2 to 10 percent by weight.

* * * * *

UNITED STATES PATENT AND TRADEMARK OFFICE

CERTIFICATE OF CORRECTION

PATENT NO. : 4,954,271

DATED : September 4, 1990

INVENTOR(S) : Raymond W. Green

It is certified that error appears in the above-identified patent and that said Letters Patent is hereby corrected as shown below:

Column 2, line 58, after "fires" insert a period.

Column 3, line 13, after "levels" insert a period.
Column 3, line 19, after "fires" insert a period.
Column 3, line 52, after "products" insert a period.
Column 3, line 58, after "meters" insert a period.

Column 4, line 2, change "IB" to -- 1B --.
Column 4, line 5, change "IB" to -- 1B -- (both occurrences).
Column 4, line 11, after "setting" insert a period.
Column 4, line 13, change "IB" to -- 1B --.
Column 4, line 48, after "required" insert a period.

Column 5, line 15, change "IA" to -- 1A --.
Column 5, line 19, change "IA" to -- 1A --.
Column 5, line 21, after "seconds" insert a period.
Column 5, line 40, after "capacity" insert a period.
Column 5, line 55, after "pit" insert a period.
Column 5, line 62, after "knots" insert a period.

Column 6, line 15, start a new paragraph with the word -- The --.

Column 6, line 19, after "comparison" insert a period.
Column 6, line 48, after "reasons" insert a period.

Column 7, line 43, after "mixture" insert a period.

UNITED STATES PATENT AND TRADEMARK OFFICE

CERTIFICATE OF CORRECTION

PATENT NO. : 4,954,271

DATED : September 4, 1990

INVENTOR(S) : Raymond W. Green

It is certified that error appears in the above-identified patent and that said Letters Patent is hereby corrected as shown below:

Column 8, line 25, change "chloro" to -- dichloro --.

Signed and Sealed this

Twenty-third Day of June, 1992

*Attest:*

DOUGLAS B. COMER

*Attesting Officer*

*Acting Commissioner of Patents and Trademarks*